United States Patent [19]

Hagiwara et al.

[11] Patent Number: 4,802,253

[45] Date of Patent: Feb. 7, 1989

[54] DRY CLEANING METHOD USING AT LEAST TWO KINDS OF SOLVENTS

[75] Inventors: Haruo Hagiwara; Hideo Tsukamoto; Yasuhiro Tsubaki, all of Nagoya, Japan

[73] Assignee: Mitsubishi Jukogyo Kabushiki Kaisha, Tokyo, Japan

[21] Appl. No.: 89,122

[22] Filed: Aug. 25, 1987

Related U.S. Application Data

[62] Division of Ser. No. 14,655, Feb. 13, 1987, which is a division of Ser. No. 813,698, Dec. 27, 1985, Pat. No. 4,712,392.

[30] Foreign Application Priority Data

Dec. 28, 1984 [JP] Japan ..... 59-277497
Dec. 28, 1984 [JP] Japan ..... 59-277498

[51] Int. Cl.[4] ..... D06F 43/08
[52] U.S. Cl. ..... 8/158
[58] Field of Search ..... 8/158, 142; 68/18 R, 68/18 F, 18 C; 210/167; 202/170, 186, 202; 203/87; 134/12, 109, 111

[56] References Cited

U.S. PATENT DOCUMENTS

| | | | |
|---|---|---|---|
| 2,438,252 | 3/1948 | Richardson | 203/87 |
| 2,759,346 | 8/1956 | Beduhn | 68/18 F |
| 2,979,375 | 4/1961 | Kircher, Jr. et al. | 68/18 R X |
| 4,444,625 | 4/1984 | Smith | 202/170 X |

FOREIGN PATENT DOCUMENTS

| | | | |
|---|---|---|---|
| 2812666 | 10/1978 | Fed. Rep. of Germany | 68/18 F |

*Primary Examiner*—Philip R. Coe

*Attorney, Agent, or Firm*—Birch, Stewart, Kolasch & Birch

[57] ABSTRACT

The present invention relates to a dry cleaning method in which tanks for exclusively receiving at least two kinds of solvents which are soluble in each other are provided. One treating tank and a fractionating device for recovering the two or more kinds of solvents by fractonal distillation are provided. Exclusive filters for the respective solvents are provided through the use of, a common filter or a multi-filter device composed of both the filters which is disposed between the tanks and the treating tank. The two or more kinds of solvents are used independently so that washing is carried out. Further, the present disclosure relates to a dry cleaning method in which in a dry cleaner using organic solvents such as perchloroethylene, 1,1,1-trichloroethane, turpentine (oil series) and the like, the previously use solvent is replaced with another solvent which is soluble therein and has a lower boiling point, for exmple, Flon 113 or 11, during washing or immediately before drying in order to thereby shorten a drying period of time. According to this disclosure, the most proper washing method can be chosen for the greater part of materials, processings and forms of clothes, and troubles due to the wasing of the clothes can be reduced remarkably. Further, the disclosed apparatus and method can advantageously save occupation space, equipment cost, volume of facilities, maintenace cost and the like. In addition thereto, a drying time can be reduced by half.

1 Claim, 4 Drawing Sheets

DRY CLEANING METHOD USING AT LEAST TWO KINDS OF SOLVENTS

This application is a divisional of copending application Ser. No. 014,655, filed on Feb. 13, 1987, which is a divisional of copending application Ser. No. 813,698, filed on Dec. 27, 1985, and now U.S. Pat. No. 4,712,392.

BACKGROUND OF THE INVENTION (i) Field of the Invention

The present invention relates to a dry cleaning method wherein at least two kinds of solvents are used.

(ii) Description of the Prior Art

For the understanding of a conventional dry cleaning technique, a dry cleaning process of using solvents other than turpentine will be described in reference to FIG. 6 in which the conventional dry cleaning system is shown. First, clothes 2 are thrown into a treating tank 10 by opening a door 1, and after the door 1 has been shut, the operation of the dry cleaner is begun. Afterward, a cleaning treatment generally makes progress in the following order.

(1) A solvent 4 is pumped up from a solvent tank 3 via a valve 5 by means of a pump 6 and is delivered in a predetermined amount to the treating tank 10 through a route consisting of a valve 7 and a filter 8 or a route consisting of a valve 9.

(2) A treating drum 11 is slowly rotated, and the solvent 4 is then circulated through a circuit consisting of the treating tank 10, a button trap 12, a valve 13, the pump 6, the valve 7, the filter 8 or the valve 9 in order to wash the clothes 2.

(3) The solvent 4 is discharged through a route consisting of the treating tank 10, the button trap 12, the valve 13, the pump 6, a valve 14 and a distiller 15. Afterward, the treating drum 11 is rotated at a high speed to centrifuge the solvent 4 present in the clothes 2, and the centrifuged solvent 4 is then discharged in like manner.

(4) The preceding processes (1) and (2) are repeated.

(5) The solvent 4 is discharged to the solvent tank 3 through the treating tank 10, the button trap 12, the valve 13 and the valve 5. Afterward, the treating drum 11 is rotated at a high speed to centrifuge the solvent 4 present in the clothes 2, and the centrifuged solvent 4 is discharged therefrom.

(6) The treating drum 11 is slowly rotated again, and air is circulated in the direction of an arrow 20 between the treating tank 10 and a recovery air duct 19 consisting of a fan 16, an air cooler 17 and an air heater 18, whereby the clothes 2 are dried. A solvent gas vaporized from the clothes 2 is condensed in an air cooler 17, is then delivered to a water separator 22 via a recovery passage 21, and is afterward introduced into a clean tank 24 through a solvent pipe 23.

(7) When drying has been over, dampers 25, 26 are opened as depicted by dotted lines in the drawing, and fresh air is taken in through the damper 25. Further, the uncondensed solvent gas which has not been recovered in the air cooler 17 is discharged through the damper 26 in order to take away the odor of the solvent in the clothes 2.

(8) The solvent 4 forwarded to the distiller 15 in the preceding process (3) is evaporated, and is then condensed in a condenser 27. The condensed solvent 4 is introduced into the clean tank 24 through the water separator 22 and the solvent pipe 23 and is then returned to the solvent tank 3 over an overflow partition 28. In this connection, the water separated by the water separator 22 is discharged from the system through a water pipe 29.

Another dry cleaning process of using turpentine (an oil series solvent) is shown in FIGS. 7 and 8. In general, the turpentine dry cleaning apparatus is composed of a washing and desolvating tank 100 shown in FIG. 7, which is similar to the treating tank shown in FIG. 6, and a drying exclusive tank 200 in FIG. 8 (which is called a tumbler). In the washing and desolvating tank 100, the same procedure as the above-mentioned washing processes (1), (2) and (5) of using the other solvent is taken, whereby all the processes are over. Incidentally, the turpentine dry cleaning method generally contains no distillation process, and in many cases, the purification of the solvent 4 is carried out by using a filter 8*a* which is packed with an aliphatic acid adsorbent such as porous alumina and a decolorant such as activated carbon.

Next, the desolvated clothes 2 are taken out by opening the door 1, and after the opening of a door 1*a* of the tumbler shown in FIG. 8, they are thrown into a treating tank 10*a*. In the tumbler, the outside air 20*a* is taken in through an inlet duct 19*a* by a fan 16 and is heated by an air heater 18, and the heated air is then delivered to the treating tank 10*a*. The solvent 4 in the clothes 2 is evaporated and is then discharged from the system (to the outdoors) through an outlet duct 19*a*, whereby drying is over.

The general dry cleaning processes of using various solvents have now been described above, but at present, in the dry cleaner in which these solvents can be employed, the washing and drying method of using each solvent has been independently employed, whatever solvents are selected.

Table 1 compares typical physical properties of the solvents often used presently. Further, Table 2 compares features, restrictions, faults and the like of the solvents regarding the dry cleaning on the basis of their physical properties shown in Table 1.

In order to apply to presently diversified materials, processings and forms of clothes, it is necessary to use two kinds of perchloroethylene dry cleaner and Flon 113 dry cleaner, or three kinds of above cleaners and 1,1,1-trichloroethane dry cleaner. If two or more kinds of solvents are used in the conventional apparatus, purchase funds, occupation space, volume of facilities, and the like will be increased, and maintenance work will be complicated. These facts are of great concern to the cleaning trade.

FIG. 5 compares general washing and drying processes in the cases of using perchloroethylene, 1,1,1-trichloroethane, turpentine (oil series) and Flon 113 which are now widely employed. As shown in this drawing, all the methods, except for the Flon 113 method, take about 50% of the whole treatment time to accomplish drying, which fact is an obstacle to recent needs of shortening the treatment time. In addition thereto, the dry tumbling for a long period of time has a bad effect on the clothes at times, and, for example, hairiness and shrinkage of the clothes tend to be caused thereby.

TABLE 1

| | Boiling point (°C.) | Specific gravity (g/cc) | KB value | Ignition point |
|---|---|---|---|---|
| 1,1,1-Trichloroethane | 74 | 1.35 | 124 | Not burnt |

TABLE 1-continued

| | Boiling point (°C.) | Specific gravity (g/cc) | KB value | Ignition point |
|---|---|---|---|---|
| Perchloroethane | 121 | 1.62 | 90 | Not burnt |
| Furon R113 | 47.5 | 1.58 | 31 | Not burnt |
| Turpentine (oil series) | 150–200 | 0.8 | 31 | 38° C. |

The KB values in Table 1 are scales for representing relative dissolving powers of the solvents.

TABLE 2

1,1,1-Trichloroethane:
- (Features)
  - Dissolving power and washing power are great.
  - Reverse contamination scarcely occurs.
  - Boiling point is relatively low.
  - Suitable for men's suits, wool knitwears, etc.
- Low-temperature drying is possible.
- (Restrictions and faults)
  - Unsuitable for urethane-processed articles, recently commercially available delicate clothes containing adhesive materials, pigments, prints, specific resins, gums, etc.
  - Main portion of used apparatus is made from stainless steel.
- (Remarks)
  - Recovery of activated carbon is a little hard (stability of recovered solvent is poor).
  - In the last several years, market grows rapidly.

Perchloroethylene:
- (Features)
  - Dissolving power and washing power are next largest to 1,1,1-trichloroethane.
  - Having the next highest boiling point to turpentine.
  - Suitable for men's suits, wool knitwears, etc.
- (Restrictions and faults)
  - Substantially ditto.
  - Since drying temperature is a little higher, attention must be paid to materials which are low in heat resistance.
- (Remarks)
  - Of synthetic solvents, the most prevalent.
  - Main portion of used apparatus can be made from plated iron.

Flon 113:
- (Features)
  - Dissolving power and washing power are small.
  - Having lower boiling point.
  - Applicable to most clothing materials (suitable for delicate clothes).
  - Low-temperature and short-time drying is possible.
- (Restrictions and faults)
  - Because of weak washing power, removal of soils are difficult.
  - Solvent recovering technique by freezing or by use of activated carbon is necessary.
  - Main portion of used apparatus is made from stainless steel.
- (Remarks)
  - Most expensive.
  - Market grows slowly.

SUMMARY OF THE INVENTION

An object of the present invention is to provide a dry cleaning method which can be applied to varied materials, processings, and forms of clothes.

Still another object of the present invention is to provide a dry cleaning method by which there can be overcome problems such as hairiness and shrinkage due to a long-term drying in a conventional dry cleaning process.

The above-mentioned objects are as follows:

The method of the present invention is carried out with a dry cleaning apparatus in which tanks for exclusively receiving at least two kinds of solvents which are soluble in each other, one treating tank connected to the tanks, and a fractionating device, connected to the tanks and the treating tank, for recovering the two or more kinds of solvents by fractional distillation. Exclusive filters for the respective solvents are provided wherein a common filter or a multi-filter device composed of both the filters is disposed between the tanks and the treating tank. The two or more kinds of solvents are used independently so that washing is carried out.

The dry cleaning method of the present invention comprises the steps of providing tanks for exclusively receiving at least two kinds of solvents which are soluble in each other, connecting one treating tank to the tanks, providing a fractionating device, connected to the tanks and the treating tank, recovering the two or more kinds of solvents by fractional distillation through the use of the fractionating device, providing exclusive filters for the respective solvents through the use of a common filter or a multi-filter device composed of both the filters which is disposed between the tanks and the treating tank,; and using the two or more kinds of solvents independently so that washing is carried out.

Also disclosed in this application is a dry cleaning method in which a dry cleaner using organic solvents such as perchloroethylene, 1,1,1-trichloroethane, turpentine (oil series) and the like, the previously used solvent is replaced with another solvent which is soluble therein and has a lower boiling point, for example, Flon 113 or 11, during washing or immediately before drying in order to thereby shorten a drying period of time.

The present invention thus constituted, provides the following effects:

(I) Two or more solvents can be used in optional ratios in one dry cleaner, and thus the most proper washing method can be chosen for the greater part of materials, processings and morphologies of clothes. Further, it is possible to remarkably reduce troubles (faulty washing, creases, shrinkages, discoloration, deformation, removal of adhesive materials, and the like) regarding a washing technique. Also in points of occupation space, fund for facilities, volume of facilities and maintenance cost, the present invention has great advantages.

(II) According to the dry cleaning method of the present invention, a drying time can be shortened noticeably and a bad influence of tumbling on clothes can be reduced.

BRIEF DESCRIPTION OF THE DRAWINGS

FIG. 5 is a comparative illustrative view of washing and drying processes by the use of various usual solvents such as perchloroethylene and the like;

DESCRIPTION OF THE PREFERRED EMBODIMENT

Now, preferable embodiments for the practice of the present invention will be described in accordance with accompanying drawings:

EMBODIMENT 1

Figure 1:
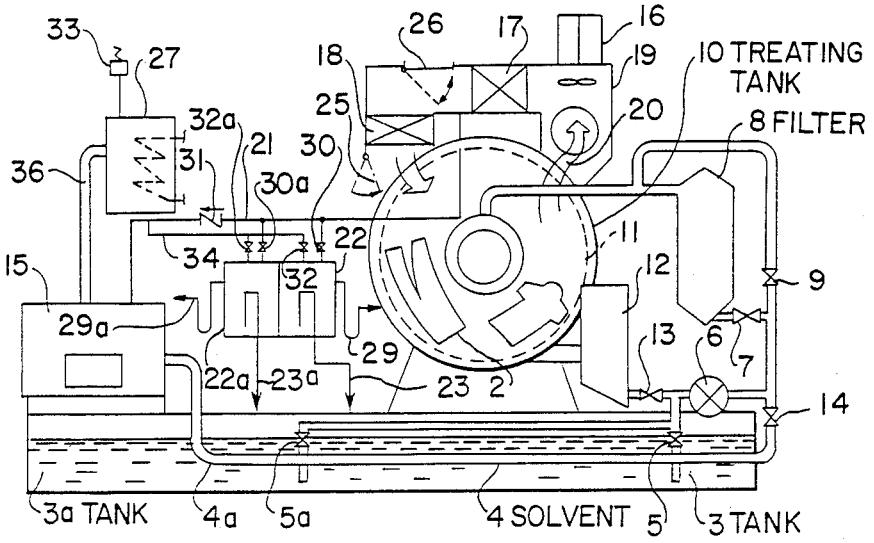
FIG. 1 is a systematic view illustrating a first embodiment of a dry cleaning apparatus regarding the present invention.
Figure 2:
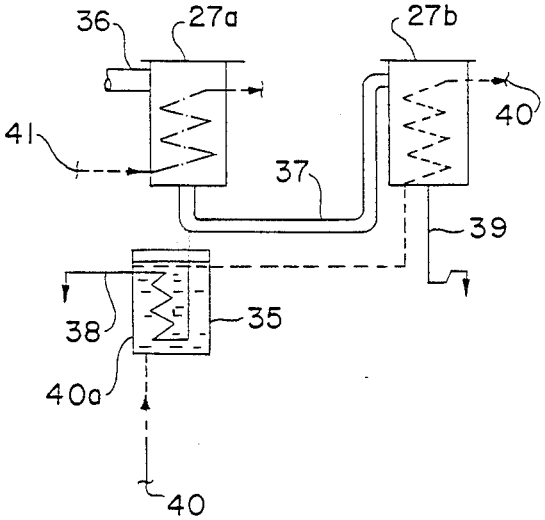
FIG. 2 is a circuit diagram illustrating a fractionating system used in the first embodiment of the present invention.
Figure 3:
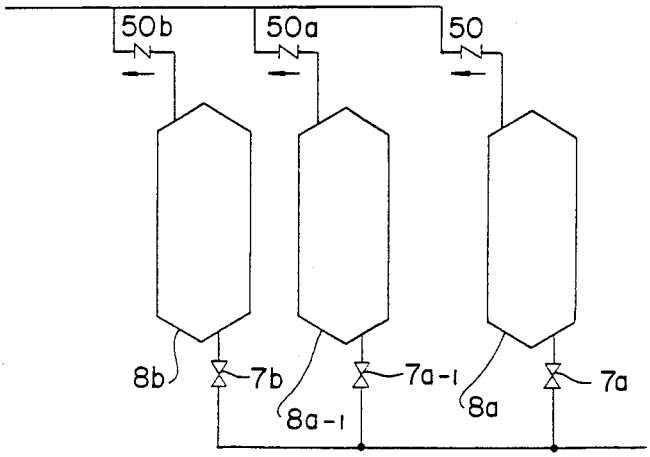
FIG. 3 is a circuit diagram illustrating a usage of specific filters containing a deoxidizer and a decolorant which are often used in the first embodiment of the present invention in which turpentine is employed.
Figure 4:
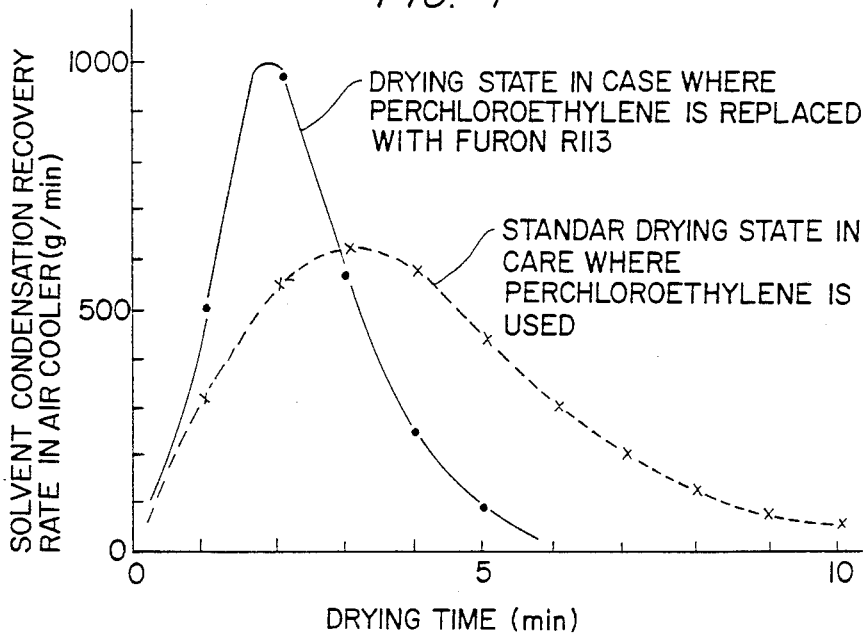
FIG. 4 is a diagram showing a relation between a drying time and a solvent condensation recovery rate in an air cooler in a second embodiment of the present invention in which the apparatus in FIG. 1 is employed.
Figure 5:
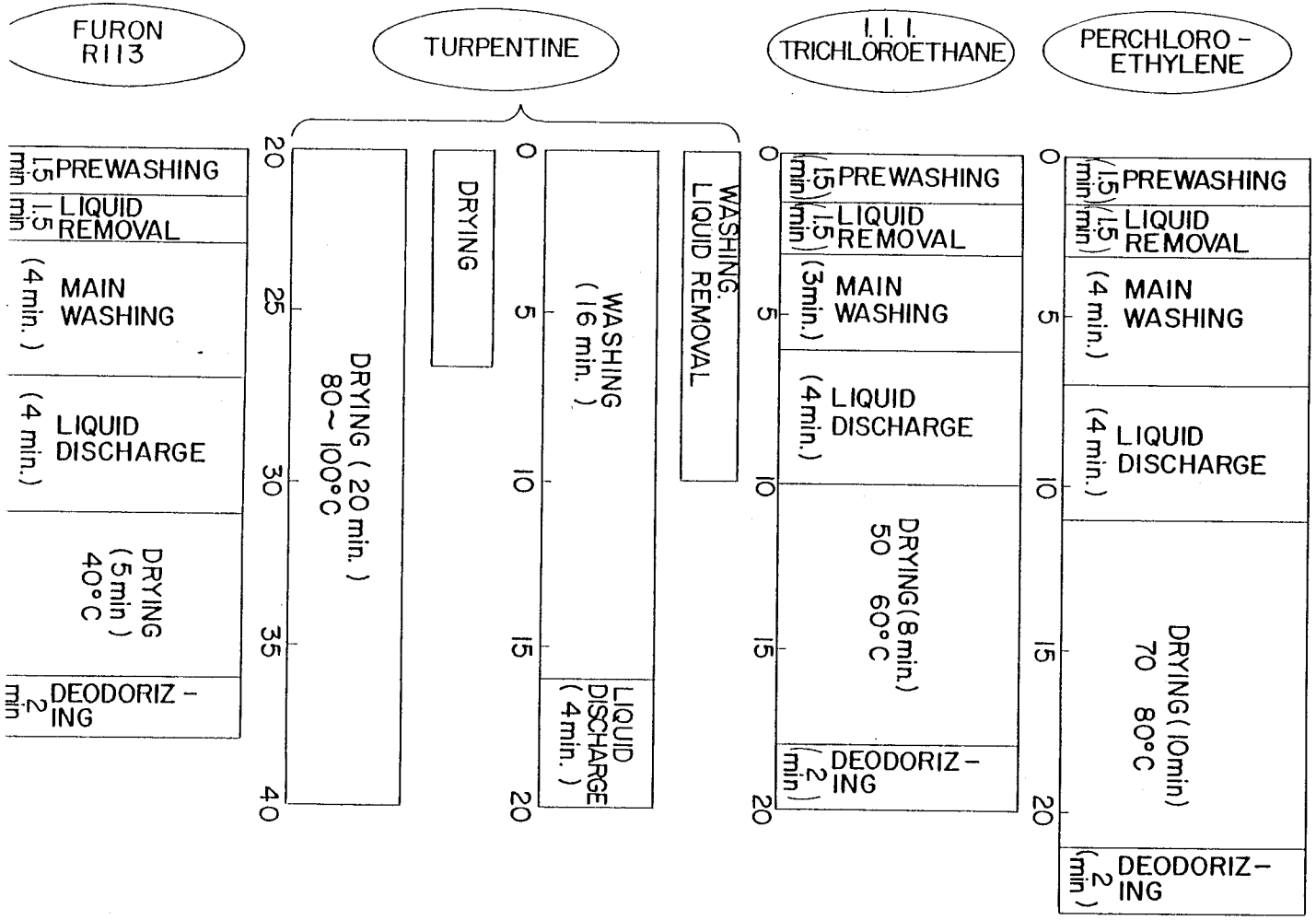

FIGS. 1 to 3 show a first embodiment of the present invention. For simplification, these drawings exemplarily show exclusive solvent tanks for two kinds of solvents and a fractionating device or a filter structure, but needless to say, they can serve for three or more kinds of solvents in all the same volume.

Figure 6:
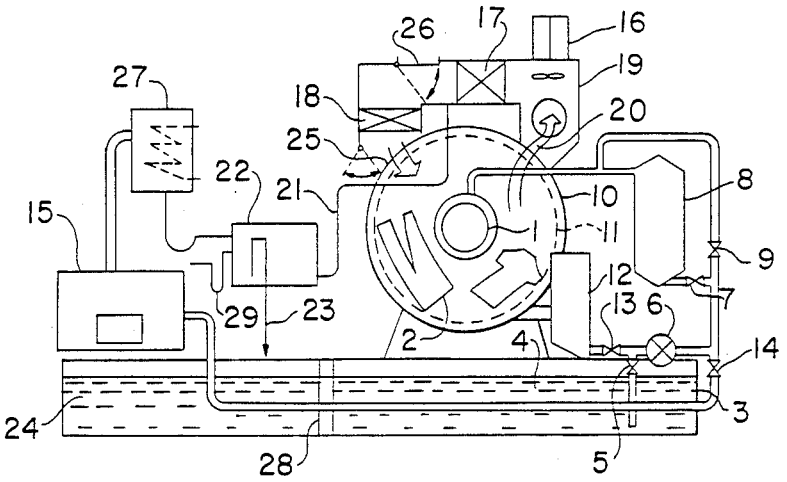
FIG. 6 PRIOR ART
FIG. 6 is a systematic view of a conventional dry cleaner.
Figure 7:
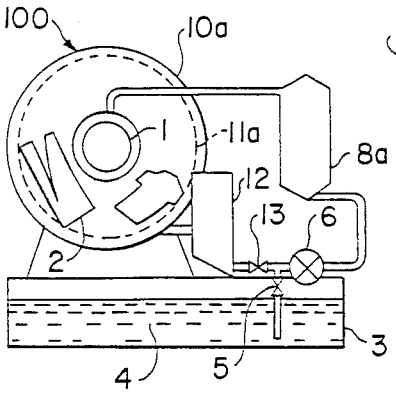
FIG. 7 PRIOR ART
FIGS. 7 and 8 are illustrative views of a conventional dry cleaning process of using turpentine.
Figure 8:
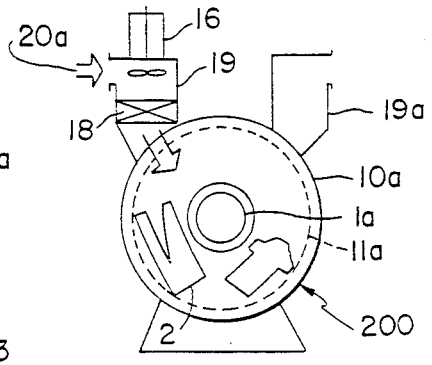
FIG. 8 PRIOR ART

With regard to differences between a fundamental embodiment of the present invention shown in FIG. 1 and the above-mentioned constitution (the conventional method) shown in FIG. 6, a first difference is that a first solvent receiving tank 3 and a second solvent receiving tank 3*a* are disposed independently of each other and they are provided with exclusive valves 5 and 5*a*, respectively.

A second difference therebetween is that valves 32, 32*a* which are adjustable in compliance with boiling points inherent in solvents or by a program control are disposed on a condensed solvent flow pipe 34 connecting to water separators 22, 22*a*; solvent pipes 23, 23*a* and water pipes 29, 29*a* are provided; and a safety valve 33 is additionally disposed on a condenser 27.

A third difference is that a recovery passage 21 extending from an air cooler 17 is connected to the water separator 22 or 22*a* via a valve 30 or 30*a* and is connected to a distiller 15 via a non-return valve 31.

Except for these three differences, the structure in FIG. 1 is about the same as in FIG. 6. It can be naturally conceived to exclusively provide a pump 6 for each solvent, but for simplification, one pump 6 is here used in common.

FIG. 2 shows a constitutional example of a condenser capable of completely recovering the two kinds of solvents by fractionation. A riser 36 on the distiller 15 (FIG. 1) is connected to a first condenser 27*a* in which a cooling coil 41 is disposed. A temperature of this cooling coil 41 is adjusted to a level equal to or 2° to 3° C. higher than a lower boiling point of the two solvents by means of a control system not shown. A gas pipe 37 is connected to the bottom of the condenser 27*a* and a liquid pipe 38 branches off from the gas pipe 37. This liquid pipe 38 is dipped in a tank 35 filled with a cooling water 40*a* in a low-temperature cooling coil 40 and is further connected to the water separator 22*a* (FIG. 1). The above-mentioned gas pipe 37 is connected to a second condenser 27*b*, where there is disposed the low-temperature cooling coil 40 which has been cooled to a temperature enough to condense the low boiling point solvent. Further, a liquid pipe 39 extends downward from the bottom of the condenser 27*b* and is connected to the water separator 22 (FIG. 1).

FIG. 3 is a constitutional example of specific filters containing a deoxidizer and a decolorant which have often been used in a turpentine (oil series) dry cleaning system. Filters 8*a*, 8*a*-1 and 8*b* in this drawing are all the especial filters, and these filters are equipped with exclusive valves 7*a*, 7*a*-1 and 7*b* and non-return valves 50, 50*a*, 50*b*, respectively. Further, these filters are connected to a pipe in parallel.

Next, reference will be made to a function of the embodiment thus constituted. First, in the case of separately using the two kinds of solvents without mixing them, washing and drying processes are much the same as in a conventional method (FIG. 6), and so a detailed description about them will be omitted here. It is however to be noted that opening and shutting of the valves 30 or 30*a* disposed on the recovery passage 21 extending from the air cooler 17 are controlled by the program control system (not shown) in response to the kinds of solvents so that the solvents 4, 4*a* may not be mixed with each other in the connected water separators 22, 22*a* and tanks 3, 3*a*.

Also with regard to the distillation, the opening and shutting of the valves 32, 32*a* disposed on the condensed solvent flow pipe 34 extending from the condenser 27 are controlled by the program control system (not shown) in compliance with the kinds of solvents, or alternatively these vavles 32, 32*a* are opened or shut by detecting a temperature of the solvent in the distiller 15 with the aid of a temperature sensor (not shown) in order to avoid mixing the solvents 4, 4*a* with each other. As a result, in both the cases of the drying and distillation, the solvents 4, 4*a* flow into the exclusive tanks 3, 3*a*, respectively. Incidentally, one distiller is disposed in this embodiment, but needless to say, plural exclusive distillers may be provided for the respective solvents.

Next, detailed reference will be made to the case where the two kinds of solvents are positively mixed and used in an optional ratio.

(1) The first solvent 4 is pumped up from the tank 3 via the valve 5 by means of the pump 6 and is delivered in a predetermined amount to the treating tank 10 through the valve 7 and the filter 8 or through the valve 9. Successively, the second solvent 4*a* is pumped up from the tank 3*a* via the valve 5*a* in like manner.

(2) A treating drum 11 is slowly rotated, and a mixed solvent (4+4*a*) is circulated through a circuit consisting of the treating tank 10, a button trap 12, a valve 13, the pump 6, the valve 7 and the filter 8 or the valve 9.

(3) The mixed solvent (4+4*a*) is discharged through a route consisting of the treating tank 10, the button trap 12, the valve 13, the pump 6, a valve 14 and the distiller 15. Afterward, the treating drum 11 is rotated at a high speed to centrifuge the solvent (4+4*a*) present in the clothes 2, and the centrifuged solvent (4+4*a*) is discharged in like manner.

(4) The preceding processes (1), (2) and (3) are repeated. Alternatively, after the preceding processes (1) and (2) have been repeated, the mixed solvent (4+4*a*) is discharged to a third tank (not shown) through the treating tank 11, the button trap 12, the valve 13 and the pump 6.

(5) The treating drum 11 is slowly rotated again, and air is circulated in the direction of an arrow 20 between the treating tank 10 and a recovery air duct 19 consisting of a fan 16, the air cooler 17 and an air heater 18, whereby the clothes 2 are dried. A solvent gas vaporized from the clothes 2 is condensed in the air cooler 17 and is delivered to the distiller 15 through the recovery circuit 21 containing the non-return valve 31.

(6) When drying has been over, dampers 25, 26 are opened as depicted by dotted lines in the drawing, and fresh air is taken in through the damper 25. Further, the uncondensed solvent gas which has not been recovered by the air cooler 17 is discharged through the damper 26 in order to take away the odor of the solvent in the clothes 2.

(7) The mixed solvent (4+4*a*) forwarded to the distiller 15 in the preceding processes (3), (4) and (5) is distilled at a lower boiling point (for example, of the solvent 4) of the respective solvents, and is caused to pass through a condenser 27. The mixed solvent condensed therein is then introduced into the water separator 22 via the valve 32 opened under a control of a distillation temperature sensor (not shown), and is further returned to the solvent tank 3 through a solvent pipe 23.

Next, as an amount of the solvent having the lower boiling point in the distiller 15 is reduced, a temperature of the mixed solvent progressively approaches a boiling point of the other solvent having a higher boiling point and the distillation of the latter begins. At this time, however, the distillation temperature sensor (not shown) operates in the same manner as described above, in order to open the valve 32*a* (the valve 32 is shut), thereby recovering the high boiling point solvent 4*a* in the tank 3*a* in the same manner as described above (a solvent of an intermediate component in the transition from the low boiling point solvent to the high boiling point solvent is as small as trace in experiments, and thus it has no problem in practice. In consequence, the intermediate solvent may be handled as the low or the high boiling point solvent).

Now, the fractional system shown in FIG. 2 will be briefly described. The low boiling point solvent 4 evaporated in the distiller 15 (FIG. 1) is, to begin with, introduced into the first condenser 27*a*, but it is not condensed therein, because a temperature of the cooling water in the cooling coil 41 is higher than the boiling point of the low boiling point solvent. Therefore, the latter is delivered through the gas pipe 37 to the second condenser 27*b*, wherein it is condensed by the low-temperature cooling coil 40, and the condensed solvent then runs into the water separator 22 via the liquid pipe 39. When the high boiling solvent begins to evaporate, the recovery of the solvent in the first condenser 27*a* becomes possible, and the condensed solvent runs into the water separator 22*a* through the liquid pipe 38. The tank 35 which has been filled with the cooling water 40*a* of the low-temperature cooling coil 40 serves to cool the liquid pipe 38 dipped in the cooling water 40*a*.

In the last place, with regard to the specific filer containing a deoxidizer and a decolorant which have often been used in the turpentine (oil series) dry cleaning system, its use example will be described briefly in reference to FIG. 3. In the case that washing is carried out by switching the two kinds of solvents so as to independently use them, the filters 8*a*-1 and 8*b* are used exclusively. For example, when the filter 8*a*-1 is employed for the first solvent 4, the valve 7*a*-1 alone is opened and the others are shut. The solvent 4 which has passed through the filter 8*a*-1 pushes the non-return valve 50*a* and runs into the treating tank 10 (FIG. 1).

In the case that the two kinds of mixed solvents are employed, the filter 8*a* alone is used in the same manner as described above so that the solvent components in the filters 8*a*-1, 8*b* may not be changed.

EMBODIMENT 2

This embodiment of the present invention relates to a dry cleaning method in which the dry cleaning apparatus shown in FIG. 1 is used, and a description will be given in reference to FIG. 1.

If the first and second solvents 4 and 4*a* are regarded as a low boiling point solvent and a high boiling point solvent, respectively, the latter 4*a* will be replaced with the former 4 in the dry cleaning apparatus during washing. The procedure of this replacement will be first described.

(1) The high boiling point solvent 4*a* is pumped up from the tank 3 via the valve 5*a* by means of the pump 6 and is delivered in a predetermined amount to the treating tank 10 through the valve 7 and the filter 8 or through the valve 9.

(2) A treating drum 11 is slowly rotated, and the high boiling point solvent 4*a* is circulated through a circuit consisting of the treating tank 10, the button trap 12, the valve 13, the pump 6, the valve 7, the filter 8 or the valve 9, in order to wash the clothes 2.

(3) The solvent 4*a* is discharged through the treating tank 10, the button trap 12, the valve 13, the pump 6, the valve 14 and the distiller 15. Afterward, the treating drum 11 is rotated at a high speed to centrifuge the high boiling point solvent 4*a* present in the clothes 2, and the centrifuged solvent 4*a* is discharged in like manner.

(4) The low boiling point solvent 4 is pumped up from the tank 3 via the valve 5*a* by means of the pump 6 and is delivered in a predetermined amount to the treating tank 10 through the valve 7 and the filter 8 or through the valve 9.

(5) This step is the same as in the preceding paragraph (2) (however, the high boiling point solvent 4*a* should be changed to the low boiling point solvent 4).

(6) This step is the same as in the preceding process (3) (however, the high boiling point solvent 4*a* should be changed to the low boiling point solvent 4).

(7) The treating drum 11 is slowly rotated again, and air is circulated in the direction of an arrow 20 between the treating tank 10 and the recovery air duct 19 consisting of the fan 16, the air cooler 17 and the air heater 18, whereby the clothes 2 are dried. A solvent gas vaporized from the clothes 2 is condensed in the air cooler 17 and is then delivered to the distiller 15 through the recovery circuit 21 having the non-return valve 31.

(8) When drying has been over, dampers 25, 26 are opened as depicted by dotted lines in the drawing, and fresh air is taken in through the damper 25. Further, the uncondensed solvent gas which has not been recovered by the air cooler 17 is discharged through the damper 26 in order to take away the odor of the solvent in the clothes 2.

(9) The mixed solvent (4+4*a*) forwarded to the distiller 15 in the preceding processes (3), (6) and (7) is first distilled at a lower boiling point of the respective solvents, and is then caused to pass through the condenser 27. The mixed solvent condensed therein is afterward introduced into the water separator 22 via the valve 32 opened under a control of a distillation temperature sensor (not shown), and is further returned to the solvent tank 3 through the solvent pipe 23.

Next, as an amount of the solvent having the lower boiling point in the distillate 15 is reduced, a temperature of the mixed solvent progressively approaches a boiling point of the other solvent 4*a* having a higher boiling point and the distillation of the latter 4*a* begins. At this time, however, the distillation temperature sensor (not shown) operates in the same manner as described above, in order to open the valve 32*a* (the valve 32 is shut), thereby recovering the high boiling point solvent 4*a* in the tank 3*a* in the same manner as described above (a solvent of an intermediate component in the transition from the low boiling point solvent to the high boiling point solvent is as small as trace in experiments, and thus it has no problem in practice. In consequence, the intermediate solvent may be handled as the low or the high boiling point solvent).

Next, brief reference will be made to a procedure of replacing the high boiling point solvent 4*a* with the low boiling point solvent 4 immediately before drying.

(1) A washing process makes progress in about the same manner as in the preceding processes (1) to (4) regarding FIG. 6 (the tank 3 and the solvent 4 in FIG. 6 should be changed to the tank 3*a* and the high boiling point solvent 4*a*).

(2) The low boiling point solvent 4 is pumped up from the tank 3 via the valve 5 by means of the pump and is delivered in a predetermined amount to the treating tank 10 through the route consisting of the valve 7 and the valve 9.

The subsequent processes are all the same as in the process (6) et seq. regarding the above-mentioned solvent replacement during washing.

What is claimed is:

1. A dry cleaning method comprising the steps of providing tanks for exclusively receiving at least two kinds of solvents which are soluble in each other, connecting one treating tank to the tanks, providing a fractionating device, connected to the tanks and the treating tank, recovering the two or more kinds of solvents by fractional distillation through the use of the fractionating device, providing exclusive filters for the respective solvents through the use of a common filter or a multi-filter device composed of both the filters which is disposed between the tanks and the treating tank, and using the two or more kinds of solvents independently so that washing is carried out.

* * * * *